United States Patent [19]

Jin et al.

[11] 4,209,756

[45] Jun. 24, 1980

[54] CIRCULATOR COMPRISING A SPRING MEMBER BETWEEN A FERRIMAGNETIC PIECE AND AN ADJACENT CONDUCTOR

[75] Inventors: Yutaka Jin; Osamu Kasuga; Tsutomu Kyuzaki, all of Tokyo, Japan

[73] Assignee: Nippon Electric Co., Ltd., Tokyo, Japan

[21] Appl. No.: 846,580

[22] Filed: Oct. 28, 1977

[30] Foreign Application Priority Data

Nov. 2, 1976 [JP] Japan ..... 51-131887

[51] Int. Cl.[2] ..... H01P 1/38

[52] U.S. Cl. ..... 333/1.1; 333/246

[58] Field of Search ..... 333/1.1, 24.1, 24.2, 333/84 M, 98 R

[56] References Cited

U.S. PATENT DOCUMENTS

| | | | |
|---|---|---|---|
| 3,225,318 | 12/1965 | Heithaus | 333/24.2 |
| 3,421,116 | 1/1969 | Frank et al. | 333/24.1 |
| 3,509,270 | 4/1970 | Dube et al. | 333/84 M UX |
| 3,621,478 | 11/1971 | Johnson et al. | 333/84 M X |
| 3,739,302 | 6/1973 | McManus | 333/24.2 X |

*Primary Examiner*—Paul L. Gensler

*Attorney, Agent, or Firm*—Ostrolenk, Faber, Gerb & Soffen

[57] ABSTRACT

In a circulator comprising at least three ports, a pair of opposing conductors providing the ports, and a ferrimagnetic piece between the conductors, a gap appearing between the ferrimagnetic piece and the conductor or conductors is taken up by a spring member located in the gap. The conductors serve as an opposing pair of conductors of a waveguide of the circulator. Alternatively, the conductors serve as ground plates of a stripline with a center conductor disposed between the ground plates and with a pair of ferrimagnetic pieces disposed on both sides of the center conductor between the ground plates. In the latter case, a pair of spring members is preferably located between the ferrimagnetic pieces and the respective ground plates. Preferably, the spring member is made of phosphor bronze and comprises a plate in contact with the ferrimagnetic piece and legs extended from the plate towards the respective ports and brought into contact with the adjacent one of the opposing conductors.

4 Claims, 10 Drawing Figures

CIRCULATOR COMPRISING A SPRING MEMBER BETWEEN A FERRIMAGNETIC PIECE AND AN ADJACENT CONDUCTOR

BACKGROUND OF THE INVENTION

This invention relates to a circulator known in microwave communication and the like.

As will later be described with reference to a few of several figures of the accompanying drawing, a circulator comprises a pair of conductors and at least one ferrimagnetic piece. A conventional circulator has been defective in that it has objectionable insertion loss, return loss, and like characteristics. The defects result mainly from the fact that the conductors are not brought into sufficient electric contact with the ferrimagnetic piece or pieces even though machined with a high mechanical precision in consideration of the dimensions of the ferrimagnetic piece or pieces.

In "The Bell System Technical Journal", Vol. 50, No. 7 (September 1971), pp. 2175–2194, N. R. Dietrich proposed a circulator wherein one of the conductors comprises a threaded conductive plug as an integral part thereof at the position of a ferrimagnetic piece. The plug is initially adjusted to be brought into electric contact with the ferrimagnetic piece. The proposed circulator is, however, complicated in structure and is expensive. It is troublesome to carry out the initial adjustment. In additions, it is not certain whether the characteristics are kept in good order even though the circulator is subjected to various ambient conditions.

SUMMARY OF THE INVENTION

It is therefore an object of this invention to provide a circulator which is simple in structure and yet has excellent characteristics.

It is another object of this invention to provide a circulator of the type described, which is not expensive.

A circulator to which this invention is applicable includes at least three ports, propagation means comprising, in turn, a pair of conductors opposing each other and providing the ports, and circulating means comprising, in turn, a ferrimagnetic piece and coupled to the propagating means with the ferrimagnetic piece disposed between the conductors. The propagation means is for propagating a signal supplied to a first of the ports to the others of the ports. The circulating means is for circulating the signal to a second of the ports that is predetermined relative to the first port. The ferrimagnetic piece is spaced from one of the conductors by a gap. According to this invention, the circulator comprises conductive spring means in the gap for positively providing electrical connection between the ferrimagnetic piece and the above-mentioned one conductor.

DESCRIPTION OF THE PREFERRED EMBODIMENTS

Figure 1:
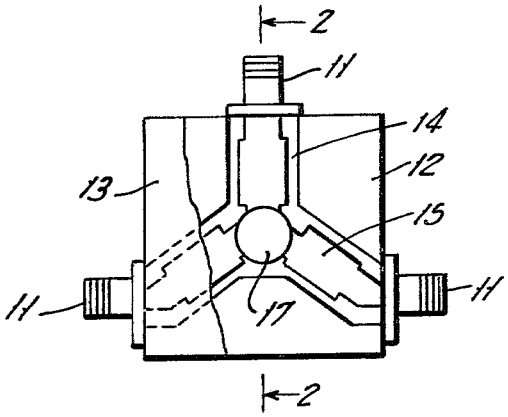
FIG. 1. PRIOR ART
FIG. 1 schematically shows a partially cut-away plan of a conventional circulator.
Figure 2:
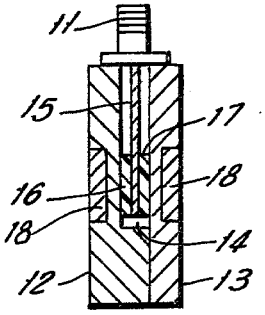
FIG. 2. PRIOR ART
FIG. 2 is a sectional view taken along a line 2—2 of FIG. 1.

Referring to FIGS. 1 and 2, description will be made of a conventional circulator of a micro strip line type for a better understanding of this invention. The conventional circulator comprises three ports 11 and first and second conductors 12 and 13. The first conductor 12 has a groove having, in turn, a center portion and branches extended from the center portion to the respective ports 11. The second conductor 13 is a flat plate and is put on the first conductor 12 to make the groove form a space 14 limited between the conductors 12 and 13. In the space 14, a stripline center conductor 15 having a center area is extended between the ports 11 with the center area located in the center portion of the groove. The conductors 12 and 13 serve as ground plates of the stripline. A pair of ferrimagnetic pieces 16 and 17 are placed in the center portion of the groove and brought into contact with both sides of the center area of the stripline center conductor 15. A static magnetic field is impressed perpendicular to the ferrimagnetic pieces 16 and 17 by a pair of magnets 18 located in the respective conductors 12 and 13 in order to circulate a signal supplied to a first of the ports 11 to a second port thereof that is predetermined relative to the first port. In other words, the circulator comprises a pair of conductors 12 and 13 for propagating, in cooperation with the center conductor 15, a signal supplied to one of the ports 11 to the others of the ports 11 and a circulating device coupled to the propagating arrangement with the ferrimagnetic pieces 16 and 17 disposed between the conductors 12 and 13. It is to be noted here that it is almost impossible to avoid the existence of a gap between at least one of the ferrimagnetic pieces 16 and 17 and the adjacent one of the conductors 12 and 13 however precise the elements 12, 13, 15, 16, and 17 may be machined. When the ferrimagnetic pieces 16 and 17 are rendered thicker for the purpose of decreasing the gap, it is very likely that another gap will appear between the conductors 12 and 13 to adversely affect the signal propagating action of the conductors 12 and 13.

Figure 3:
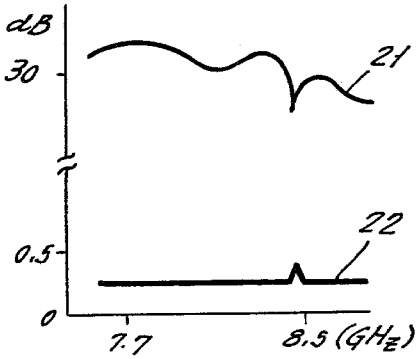
FIG. 3. PRIOR ART
FIG. 3 shows attenuation versus frequency characteristics of a certain circulator of the type illustrated in FIGS. 1 and 2.
Figure 4:
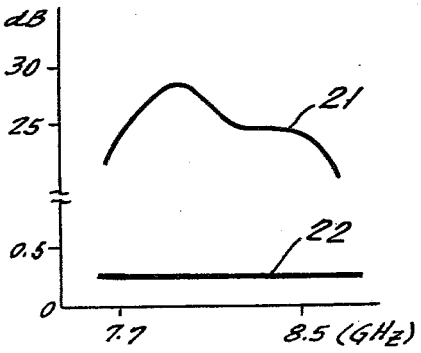
FIG. 4. PRIOR ART
FIG. 4 shows similar attenuation versus frequency characteristics of another circulator of the type illustrated in FIGS. 1 and 2.

Referring to FIGS. 3 and 4 wherein the abscissae and ordinates represent frequency in GHz and attenuation in dB, curves 21 and 22 show isolation characteristics and insertion loss characteristics, respectively, of one and another of conventional circulators of the type illustrated with reference to FIGS. 1 and 2. With one of the circulators, a negative-going and a positive-going peak appear in both curves 21 and 22 within a desired frequency band of the circulator as exemplified in FIG. 3. The peaks are adverse effects caused in the circulator characteristics by resonance resulting from the above-mentioned gap. With the other of the circulators, a reduction in the isolation at higher frequencies cannot be avoided as exemplified in FIG. 4. This is again an adverse effect resulting from presence of the gap. Therefore, an optimally usable frequency bandwidth of a conventional circulator is objectionably narrow.

Figure 5:
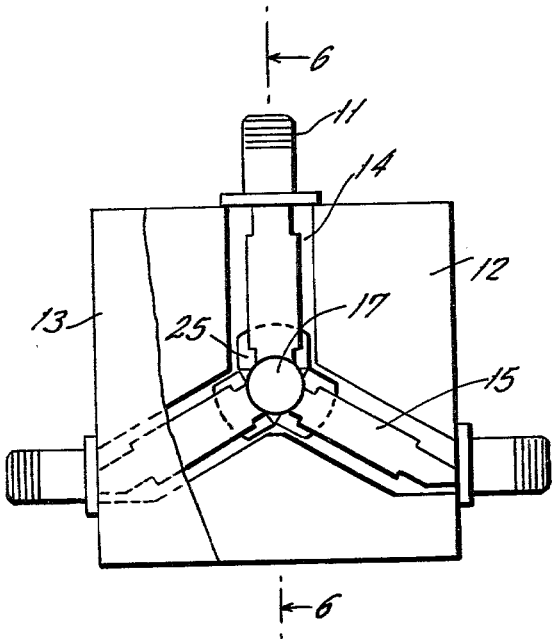
FIG. 5 schematically shows a partially cut-away plan of a circulator according to a preferred embodiment of this invention.
Figure 6:
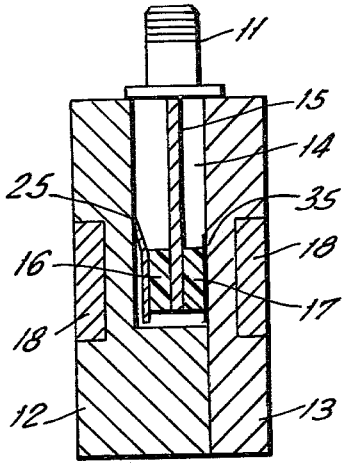
FIG. 6 is a sectional view taken along a line 6—6 of FIG. 5.

Referring now to FIGS. 5 and 6, a circulator according to a preferred embodiment of this invention comprises similar parts designated by like reference numerals as in FIGS. 1 and 2. As in the conventional circulator, a first of the ferrimagnetic pieces 16 and 17 is offset adjacent to the first conductor 12. The circulator further comprises a metallic spring 25 between the first ferrimagnetic piece 16 and the first conductor 12 to positively bring the first ferrimagnetic piece 16 into electrical contact with the first conductor 12. In other words, the metallic spring 25 positively provides electrical connection between the first ferrimagnetic piece 16 and the first conductor 12. Due to the spring action of the metallic spring 25, the other ferrimagnetic piece 17 is also brought into ohmic contact with the second conductor 13.

Figure 7:
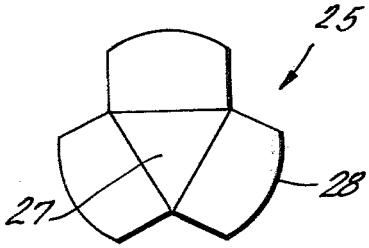
FIG. 7 is a plan view of a metallic spring for use in the circulator illustrated in FIGS. 5 and 6.
Figure 8:
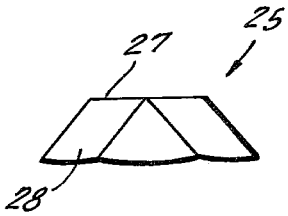
FIG. 8 is a side view of the metallic spring illustrated in FIG. 7.

Referring to FIGS. 7 and 8, a metallic spring 25 preferably comprises a plate portion 27 and three legs 28 extended outwardly from the plate portion 27. The illustrated metallic spring 25 is for use in the space 14 or groove with the plate portion 27 located in the center portion of the groove and the legs 28 extended from the center portion towards the respective ports 11 (FIGS. 5 and 6). It is possible to fixedly place the metallic spring 25 in the space 14 by bringing the legs 28 into engagement with the conductor walls defining the groove branches. Most preferably, the metallic spring 25 is made of phosphor bronze or beryllium copper.

Figure 9:
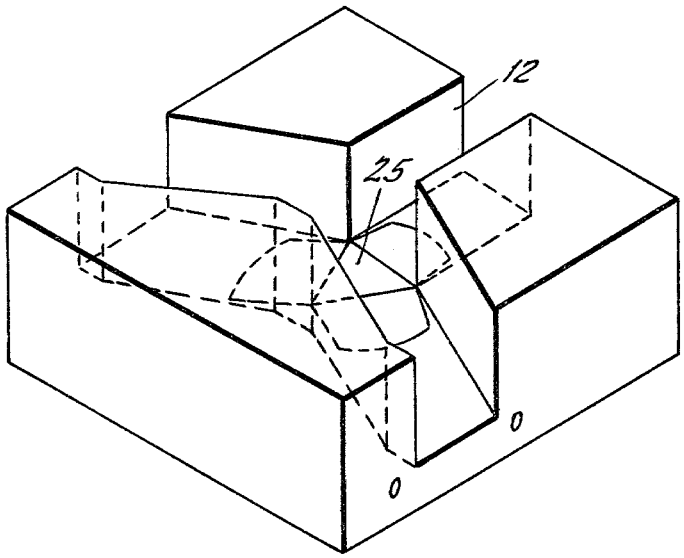
FIG. 9 is a perspective view of a conductor on which the metallic spring shown in FIGS. 7 and 8 is located.

Referring to FIG. 9, a first conductor 12 of a shape described in conjunction with FIGS. 1, 2, 5 and 6 is preferable for use in a circulator according to the preferred embodiment of this invention. This is because the conductor 12 facilitates assembly of the circulator. More particularly, the metallic spring 25 is put in the groove as illustrated with the legs 28 (FIGS. 7 and 8) made to rest on the bottom surface of the groove. The first ferrimagnetic piece 16, the center conductor 15, and the other ferrimagnetic piece 17 (FIGS. 5 and 6) are preliminarily assembled into an integral entirety by an adhesive and placed on the plate portion 27 (FIGS. 7 and 8) of the metallic spring 25, followed by putting in place of the second conductor 13.

Figure 10:
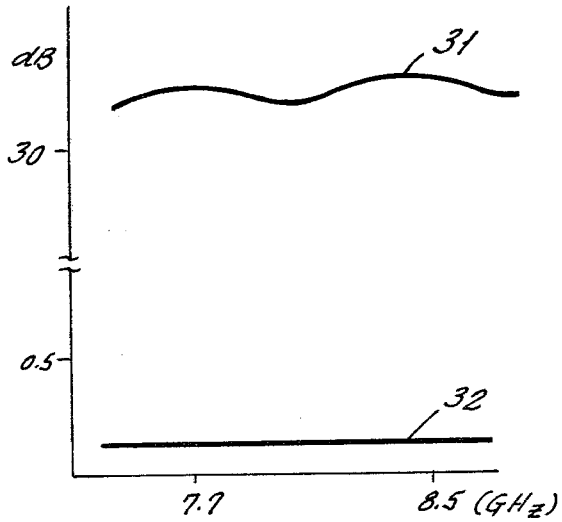
FIG. 10 shows attenuation versus frequency characteristics of a circulator according to this invention.

Referring to FIG. 10 wherein the abscissa and ordinate represent frequency in GHz and attenuation in dB, curves 31 and 32 show isolation and an insertion loss characteristic, respectively, of a circulator according to this invention. The circulator has isolation of more than 30 dB over a frequency range between 7.7 and 8.5 GHz and the insertion loss characteristics which are substantially constant all over the frequency range. Consequently, the circulator is superior in frequency characteristics to the conventional ones.

While this invention has thus far been described in specific conjunction with a preferred embodiment thereof, it is now understood that this invention greatly reduces the precision requirements for machining the elements 12, 13, 15, 16, and 17. A circulator according to this invention is simple in structure, and as such inexpensive, and yet is capable of providing excellent characteristics. It is possible to use a pair of simple metallic plates as the conductors 12 and 13. Use is possible of an additional metallic spring between the second conductor 13 and the other ferrimagnetic piece 17 at a position indicated by thick line 35 in FIG. 6. This invention is equally well applicable to a circulator having four or more ports and a circulator comprising a waveguide instead of the stripline. In a circulator comprising a waveguide, it is sufficient to use a single ferrimagnetic piece. The conductors 12 and 13 serve at least as a pair of opposing conductors of the waveguide.

What is claimed is:

1. A circulator having at least three ports, comprising:

propagation means for propagating a signal supplied to a first of said ports to the other of said ports, said propagation means including a pair of conductors opposing each other and providing said ports therebetween;

circulating means coupled to said propagating means for circulating said signal from said first port to a second port and having a predetermined location with respect to said first port;

said circulating means comprising a ferrimagnetic piece disposed between said conductors and spaced from one of said conductors by a gap, and conductive spring means located in said gap for providing electrical connection between said ferrimagnetic piece and said one conductor and for biasing said ferrimagnetic piece into contact with the other of said conductors; and a second conductive spring means located between said ferrimagnetic piece and the other of said conductors for positively providing electrical connection between said ferrimagnetic piece and said other of said conductors.

2. A circulator having at least three ports, comprising:

propagation means for propagating a signal supplied to a first of said ports to the other of said ports, said propagation means including a pair of conductors opposing each other and providing said ports therebetween;

circulating means coupled to said propagation means for circulating said signal from said first port to a second port and having a predetermined location with respect to said first port;

said circulating means comprising a ferrimagnetic piece disposed between said conductors and spaced from one of said conductors by a gap, and conductive spring means located in said gap for providing electrical connection between said ferrimagnetic piece and said one conductor and for biasing said ferrimagnetic piece into contact with the other of said conductors;

said ferrimagnetic piece being offset adjacent to said one conductor, said propagation means comprising an additional ferrimagnetic piece between said first-mentioned ferrimagnetic piece and said other of said conductors and further comprising a center conductor extended to said ports and having a center area interposed between said ferrimagnetic pieces; and a second spring means located between said additional ferrimagnetic piece and said other of said conductors for positively providing electrical connection between said additional ferrimagnetic piece and said other of said conductors.

3. A circulator having at least three ports, comprising:

propagation means for propagating a signal supplied to a first of said ports to the other of said ports, said propagation means including a pair of conductors opposing each other and providing said ports therebetween;

circulating means coupled to said propagating means for circulating said signal from said first port to a second port and having a predetermined location with respect to said first port;

said circulating means comprising a ferrimagnetic piece disposed between said conductors and spaced from one of said conductors by a gap, and conductive spring means located in said gap for providing electrical connection between said ferrimagnetic pieces and said one conductor and for biasing said ferrimagnetic pieces into contact with the other of said conductors; and said conductive spring means comprising a phosphor bronze member in the form of a plate in electrical contact with said ferrimagnetic piece and a plurality of legs extending from said plate toward said ports and brought into electrical contact with said one of said conductors.

4. A circulator having at least three ports, comprising:

propagation means for propagating a signal supplied to a first of said ports to the other of said ports, said propagation means including a pair of conductors opposing each other and providing said ports therebetween;

circulating means coupled to said first propagating means for circulating said signal from said first port to a second port and having a predetermined location with respect to said first port;

said circulating means comprising a ferrimagnetic piece disposed between said conductors and spaced from one of said conductors by a gap, and conductive spring means located in said gap for providing electrical connection between said ferrimagnetic piece and said one conductor and for biasing said ferrimagnetic piece into contact with the other of said conductors; and said conductive spring means comprising a beryllium copper member defined by a plate in electrical contact with said ferrimagnetic piece and a plurality of legs extending from said plate toward said ports and brought into electrical contact with said one conductor.

* * * * *